US006011349A

United States Patent [19]

Amano et al.

[11] Patent Number: 6,011,349

[45] Date of Patent: Jan. 4, 2000

[54] CATHODE RAY TUBE

[75] Inventors: Yasunobu Amano, Tokyo; Naruhiko Endo, Fukushima; Yoichi Ohshige; Masahiko Mizuki, both of Kanagawa; Yoshiaki Takasaka, Tokyo, all of Japan

[73] Assignee: Sony Corporation, Japan

[21] Appl. No.: 09/035,014

[22] Filed: Mar. 5, 1998

[30] Foreign Application Priority Data

Mar. 14, 1997 [JP] Japan ..... P09-061538

[51] Int. Cl.[7] ..... H01J 29/48

[52] U.S. Cl. ..... 313/417; 313/451

[58] Field of Search ..... 313/412, 414, 313/417, 449, 451

[56] References Cited

U.S. PATENT DOCUMENTS

| | | | |
|---|---|---|---|
| Re. 35,548 | 7/1997 | Sluyterman et al. | 315/368.28 |
| 4,243,911 | 1/1981 | Winarsky et al. | 315/3 |
| 4,639,640 | 1/1987 | Hata et al. | 315/3 |
| 4,786,842 | 11/1988 | Shimoma et al. | 315/3 |
| 5,212,423 | 5/1993 | Noguchi et al. | 313/414 |
| 5,479,067 | 12/1995 | Van Der Wilk et al. | 313/417 |
| 5,621,286 | 4/1997 | Toujou et al. | 315/368.1 |
| 5,670,841 | 9/1997 | Muti et al. | 313/412 |
| 5,675,211 | 10/1997 | Ueda | 313/412 |
| 5,677,591 | 10/1997 | Toujou et al. | 313/414 |

*Primary Examiner*—Nimeshkumar D. Patel
*Attorney, Agent, or Firm*—Rader, Fishman & Grauer; Ronald P. Kananen

[57] ABSTRACT

To provide a cathode ray tube stabilizing the potential at an inner wall of a neck, providing stabilized nocking effect by forced discharge among electrodes or the like, promoting the withstand voltage characteristic of an electron gun and preventing deterioration in image quality resulted from straying leakage current, an electron gun where both ends of metal lines are welded to an intermediate electrode and a focus electrode (5-1-th electrode) to surround beading glass and a voltage dividing resistor, is sealed in a neck portion and thereafter, the metal lines are heated by high frequency heating by which a metal film is formed on surfaces of an inner wall of the neck and the voltage dividing resistor and the beading glass.

7 Claims, 3 Drawing Sheets

CATHODE RAY TUBE

BACKGROUND OF THE INVENTION

1. Field of the Invention

The present invention relates to a cathode ray tube having an intermediate electrode between an anode electrode and a focus electrode and is constituted by an electric field expansion type lens as a main electron lens.

2. Description of Prior Art

In recent years, a request to increase of resolution of an electron gun has been more and more intensified. In order to realize the request, there has been proposed a cathode ray tube in which a resistor is built in the tube body, a predetermined voltage is generated by being divided from high voltage and an electric field expansion type lens, an electrostatic quadruple lens or the like is formed without supplying voltage from outside a CRT (Cathode Ray Tube) via a stem pin.

In this case, the build-in voltage dividing resistor may be fixed onto beading glass in which the resistor is formed, for example, on a ceramic substrate and reception and supply of voltage is carried out via a pin installed on the substrate Accordingly, a distance between the resistor and a neck inner wall is proximate only at a location where the resistor is fixed compared with other space.

In the meantime, there has been provided a technology in which a metal line is welded to the outer periphery of a focus electrode of an electron gun, the metal line is heated, a portion thereof is evaporated and a metal film is formed on the neck inner wall, by which the potential of the neck inner wall in the tube is stabilized and intra tube discharge is restrained.

However, in the case of an electron gun having a voltage dividing resistor for high voltage, in view of the structure, a metal line is proximate to a neck inner wall by the amount of the thickness of the voltage dividing resistor and an interval therebetween is reduced. An example thereof is shown by FIG. 6. FIG. 6 is an outline sectional view of a neck portion at the surrounding of a 5-1-th electrode (focus electrode) 5 where metal lines 16 are welded to surround a voltage dividing resistor 12 and beading glass 11. As is apparent from FIG. 6, in the case of the electron gun having the voltage dividing resistor 12, in view of the structure, the electron gun is nonsymmetrical. When the metal line is intended to heat from outside of the neck by high frequency or the like with a purpose of forming a metal thin film on the neck inner wall in order to stabilize the potential at the inner wall of the neck or restrain discharge, the metal line on the side of the substrate is excessively proximate to the inner wall of the neck compared with the opposed side and in the worst case, the metal line is brought into contact with the neck inner wall by which neck crack may be caused and therefore, the heating condition needs to be moderate.

Then, it becomes difficult to form a uniform vapor-deposited film on the inner wall of the tube body by the upper and lower two metal lines and excellent withstand voltage characteristic is difficult to maintain.

In addition thereto, the outer diameter of the electron gun is restricted from concern of approach of the metal lines to the inner wall of the neck which makes difficult large aperture formation of the lens of the electron gun.

Further, according to fabrication steps of a CRT, a knocking step is introduced after finishing a step of exhausting the CRT as a countermeasure for preventing discharge in the CRT. In this step, a voltage substantially twice as much as high voltage applied to CRT in actual operation, is previously applied to an electron gun of CRT before integration by so that which forced discharge is caused among electrodes, among leads and among the electrodes and the neck inner wall in the electron gun. In this way, burrs of metal parts or dirt at inside of CRT or the like is removed such that no discharge is caused under high pressure in the actual operation.

However, in a nocking step of CRT provided with an electron gun having a voltage dividing resistor as disclosed in the specification of Japanese Patent Application No. 9-16767, when high voltage for nocking is applied, since an electrode applied with the high voltage communicates with an intermediate electrode or a focus electrode opposed thereto by the voltage dividing resistor although the voltage dividing resistor is a high resistor, current may be conducted simply through the voltage dividing resistor. Thus only creepage discharge is caused between the electrode applied with high voltage and a holder pin for supplying the divided voltage on the substrate having the resistor and therefore, discharge among desired electrodes is difficult to cause. Then, not only forced discharge is not realized among electrodes and among electrodes and dirt present at inside of the neck, which is the original purpose, but the voltage dividing resistor per se may be destructed by concentrating discharge to the holder pin. Further, depending on cases, the divided voltage applied to a predetermined electrode may be changed by the destruction of the voltage dividing resistor, which may give rise to, for example, deterioration in focus characteristics or the like.

SUMMARY OF THE INVENTION

The present invention has been carried out in order to resolve the above-described problem and it is an object of the present invention to provide a cathode ray tube in which the potential at an inner wall of a neck is stabilized, forced discharge among electrodes in a nocking step or the like is stably caused, by which not only the nocking effect is sufficiently achieved, the withstand voltage characteristic of an electron gun is promoted but image quality deterioration caused by straying leakage current by electric charge charged to the inner wall of the neck is prevented.

In order to achieve the above-described object, according to a first aspect of the present invention, there is provided a cathode ray tube including at inside of a neck portion of a tube body an electron gun comprising at least a focus electrode, an anode electrode, an intermediate electrode applied with a voltage higher than a focus voltage applied on the focus electrode and lower than an anode voltage applied on the anode electrode and disposed between the focus electrode and the anode electrode, wherein a group of the electrodes are fixed to a plurality of pieces of beading glass along a direction of an axis of the tube body and a build-in resistor forming and supplying the voltage applied on the intermediate electrode is fixed on one face of one of the plurality of pieces of beading glass, wherein a face orthogonal to the tube axis of the tube body and including a portion of the intermediate electrode, is provided with a metal line surrounding in a circular arc shape the build-in resistor and the one face of the one of the plurality of pieces of beading glass where the build-in resistor is fixed without being brought into contact with an inner wall of neck glass at the neck portion, and wherein both ends of the metal line are welded to the intermediate electrode.

According to a second aspect of the present invention, there is provided a cathode ray tube including at inside of a neck portion of a tube body an electron gun comprising at least a focus electrode, an anode electrode, an intermediate electrode applied with a voltage higher than a focus voltage applied on the focus electrode and lower than an anode voltage applied on the anode electrode and disposed between the focus electrode and the anode electrode, wherein a group of the electrodes are fixed to a plurality of pieces of beading glass along a direction of an axis of the tube body and a build-in resistor forming and supplying the voltage applied on the intermediate electrode is fixed on one face of one of the plurality of pieces of beading glass, wherein a face orthogonal to the tube axis of the tube body and including a portion of the intermediate electrode, is provided with a metal line surrounding in a circular arc shape the build-in resistor and the one face of the one of the plurality of pieces of beading glass where the build-in resistor is fixed and other metal line surrounding in a circular arc shape other face of other one of the plurality of pieces of beading glass without being brought into contact with an inner wall of neck glass at the neck portion, and wherein both ends of the metal lines are welded to the intermediate electrode.

According to a third aspect of the present invention, there is provided the cathode ray tube in accordance with the first aspect wherein a face orthogonal to the tube axis of the tube body and including a portion of the focus electrode, is provided with a metal line surrounding in a circular arc shape the build-in resistor and the one face of the one of the plurality of pieces of beading glass where the build-in resistor is fixed without being brought into contact with the inner wall of the neck glass, and wherein both ends of the metal line are welded to the focus electrode.

According to a fourth of the present invention, there is provided the cathode ray tube in accordance with the first aspect wherein a face orthogonal to the tube axis of the tube body and including a portion of the focus electrode, is provided with a metal line surrounding in a circular arc shape the build-in resistor and the one face of the one of the plurality of pieces of beading glass where the build-in resistor is fixed and other metal line surrounding in a circular arc shape other face of other one of the plurality of pieces of beading glass without being brought into contact with the inner wall of the neck glass, and wherein both ends of the metal lines are welded to the focus electrode.

According to a fifth aspect of the present invention, there is provided the cathode ray tube in accordance with the second aspect wherein a face orthogonal to the tube axis of the tube body and including a portion of the focus electrode, is provided with a metal line surrounding in a circular arc shape the build-in resistor and the one face of the one of the plurality of pieces of beading glass where the build-in resistor is fixed without being brought into contact with the inner wall of the neck glass, and wherein both ends of the metal line are welded to the focus electrode.

According to a sixth aspect of the present invention, there is provided the cathode ray tube in accordance with the second aspect wherein a face orthogonal to the tube axis of the tube body and including a portion of the focus electrode, is provided with a metal line surrounding in a circular arc shape the build-in resistor and the one face of the one of the plurality of pieces of beading glass where the build-in resistor is fixed and other metal line surrounding in a circular arc shape other face of other one of the plurality of pieces of beading glass without being brought into contact with the inner wall of the neck glass, and wherein both ends of the metal lines are welded to the focus electrode.

According to a seventh aspect of the present invention, there is provided the cathode ray tube in accordance with any one of the first through the sixth aspects, further comprising a metal film formed by heating the metal lines from outside of the tube body and vaporizing a portion of the metal lines on surfaces of the inner wall of the neck glass, the build-in resistor and the plurality of pieces of beading glass.

DETAILED DESCRIPTION OF THE PREFERRED EMBODIMENT

Figure 1:
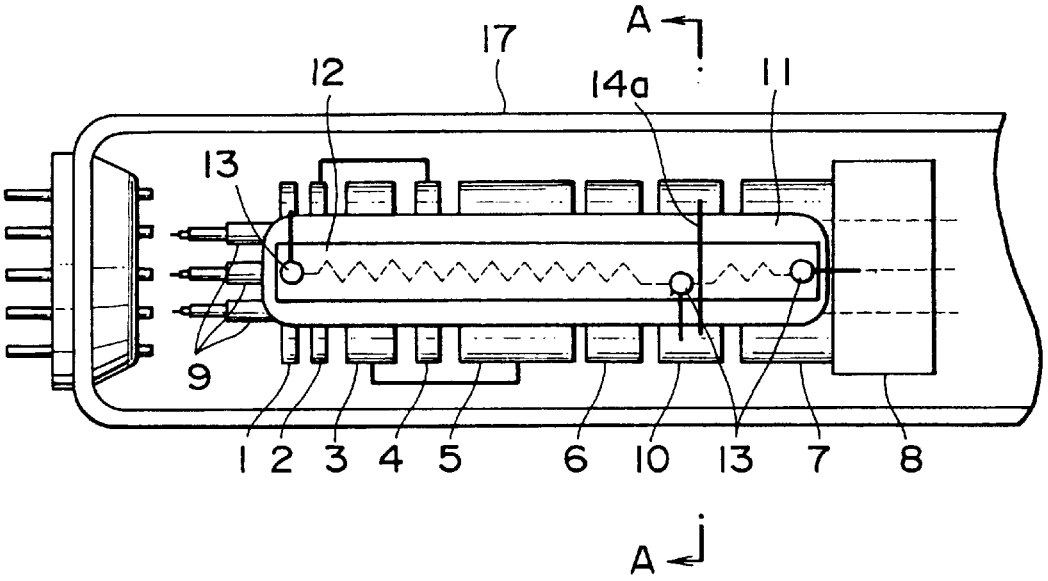
FIG. 1 is a schematic sectional view showing essential portions of a neck portion of a cathode ray tube according to a first embodiment of the present invention.
Figure 2:
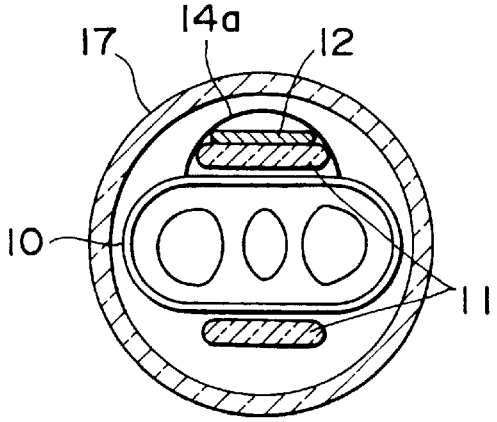
FIG. 2 is a sectional view taken from a line A—A of FIG. 1.

A detailed explanation will be given of embodiments of the present invention in reference to the drawings as follows. Incidentally, in respect of notations in the drawings, the same member or a member having the same function is designated by the same notation. FIG. 1 is a sectional view schematically showing essential portions of a neck portion of a cathode ray tube according to a first embodiment and FIG. 2 is a sectional view cutting the neck portion by A—A line. According to the present invention, an intermediate electrode is provided between a focus electrode and an anode electrode as disclosed in the specification of Japanese Patent Application No. 8-70466 and is applicable to a cathode ray tube constituted by a main lens of an electric field expansion type.

An explanation will be given of the constitution of an electron gun of a cathode ray tube used in the embodiment in reference to FIG. 1 as follows.

First Embodiment

This electron gun is an electron gun of an electric field expansion type arranged with a first electrode 1, a second electrode 2, a third electrode 3, a fourth electrode 4, a 5-1-th electrode (focus electrode) 5, a 5-2-th electrode (focus electrode) 6, an intermediate electrode 10, a sixth electrode (anode electrode) 7 and a shield cup 8 at a final stage which are successively arranged on an axis concentric with three cathodes 9 in which a positional relationship among the above-described respective electrodes is maintained by two pieces of beading glass 11. Further, a voltage dividing resistor 12 is provided to produce a voltage for supplying to the intermediate electrode in CRT and the voltage dividing resistor 12 is also fixed to the beading glass 11. Further, as shown by FIG. 2, a metal line 14*a* which is the feature of the present invention is welded and fixed to the intermediate electrode 10 to surround the beading glass 11 and the voltage dividing resistor 12.

Next, an explanation will be given of the operation of the cathode ray tube according to the embodiment. In the electron gun of the embodiment, electrons emitted from the cathodes 9 are converged on a fluorescent face by a prefocus lens constituted by the cathode 9, the first electrode 1, the second electrode 2 and the third electrode 3, a prestage lens constituted by the third electrode 3, the fourth electrode 4 and the 5-1-th electrode 5, and a main lens constituted by the 5-2-th electrode 6, the intermediate electrode 10 and the sixth electrode 7 by which an image emerges on the tube face of the cathode ray tube.

Figure 4:
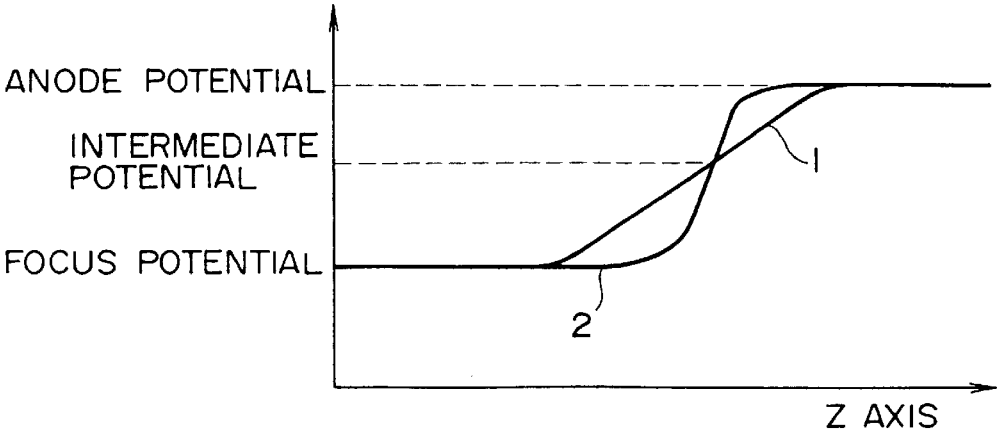
FIG. 4 is a diagram showing distribution of potential on the axis of a main electron lens for explaining an intermediate electrode.

The voltage of the intermediate electrode 10 is higher than the voltage of the focus electrode and lower than the voltage of the anode electrode and according to the embodiment, high voltage is divided by the voltage dividing resistor 12 formed on a ceramic substrate and is supplied via holder pins 13. FIG. 4 shows potential distributions on Z-axis (tube axis direction) between the focus electrode and the anode electrode caused by presence and absence of the intermediate electrode. A graph 1 in the diagram shows a case where the intermediate electrode 10 is present and a graph 2 shows the potential distribution of a conventional type lens having no intermediate electrode 10. As is apparent from the diagram, the potential distribution on the axis of the electric field expansion type lens having the intermediate electrode is gentle, the spherical aberration coefficient can be reduced, the beam spot can be reduced and accordingly, the lens is suitable for fabricating a cathode ray tube having high resolution.

An example of voltages used in the respective electrodes is shown below.

| | | |
|---|---|---|
| First electrode | (G1) | 0 V |
| Second electrode | (G2) | 500 V |
| Third electrode | (G3) | 5500 V |
| Fourth electrode | (G4) | 500 V |
| 5–1-th electrode | (G5–1) | 5500 V |
| 5–2-th electrode | (G5–2) | 5100 to 5700 V |
| Intermediate electrode | (GM) | 14000 V |
| Sixth electrode | (G6) | 27000 V |

In the meantime, generally, it is preferable to reduce the glass diameter at the neck portion of the cathode ray tube as little as possible to promote the deflection efficiency of the cathode ray tube whereas in respect of the electron gun, it is preferable to enlarge the aperture of the electron lens to reduce the diameter of the beam spot. Accordingly, clearance between the neck glass and the electron gun is narrowed as shown by FIG. 2. Therefore, the inner wall of the neck glass in operating the conventional cathode ray tube, is charged with electric charge in correspondence with the potential of an electrode opposed to the inner wall. As described above, the potential at electrodes of the electron gun is provided with a large potential gradient ranging from high voltage of 27 through 30 kV to a vicinity of the ground voltage as in the first electrode (first grid). Further, as the electric charge at high potential is charged at a vicinity of the anode electrode permeates to low potential side with elapse of time, the potential at the inner wall of the neck glass opposed to the intermediate electrode or the focus electrodes is elevated to high potential side. That is, although the main lens of the electron gun is constituted by the focus electrode, the intermediate electrode and the anode electrode, a distortion may be caused in the lens by receiving the influence of the potential at the inner wall of the neck glass by which the focus is deteriorated which gives rise to deterioration in image quality.

Hence, by fixing the metal line 14*a* to the intermediate electrode 10 to surround the beading glass 11 and the voltage dividing resistor 12 as shown by FIG. 2, the distance between the inner wall of neck glass 17 and the intermediate electrode 10 is electrically contracted and the amount of electric charge charged on the inner wall of the neck glass 17 can be stabilized.

Second Embodiment

Figure 3:
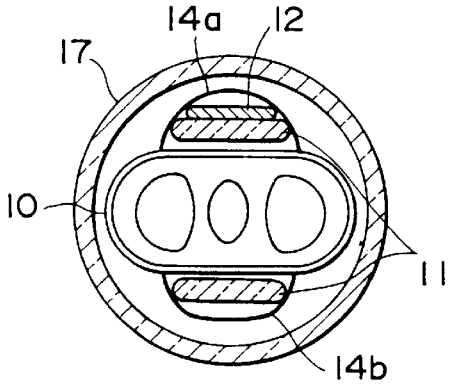
FIG. 3 is an outline sectional view of a neck portion at an intermediate electrode according to a second embodiment.

According to the first embodiment, the metal line 14*a* is arranged only at a side of the intermediate electrode 10 on a face of the beading glass 11 on the side where the voltage dividing resistor 12 is arranged. However, as shown by FIG. 3, a metal line 14*b* surrounding the beading glass 11 where the voltage dividing resistor 12 is not installed, is additionally welded to the intermediate electrode 10 by the principle and method the same as those of the first embodiment. In this way, the distance between inner wall of the neck glass 17 and the intermediate electrode 10 is electrically contracted more than that in the case of the first embodiment and the amount of electric charge charged to the inner wall of the neck glass 17 can further be stabilized.

The description in respect of the first and the second embodiments, is established similarly in respect of the focus electrode and accordingly, the potential at the inner wall of the neck glass 17 can be stabilized by arranging a metal line also on the side of the focus electrode in addition to the first or the second embodiment. An explanation will be given of an example where the metal line is arranged also on the side of the focus electrode.

Third Embodiment

Figure 5:
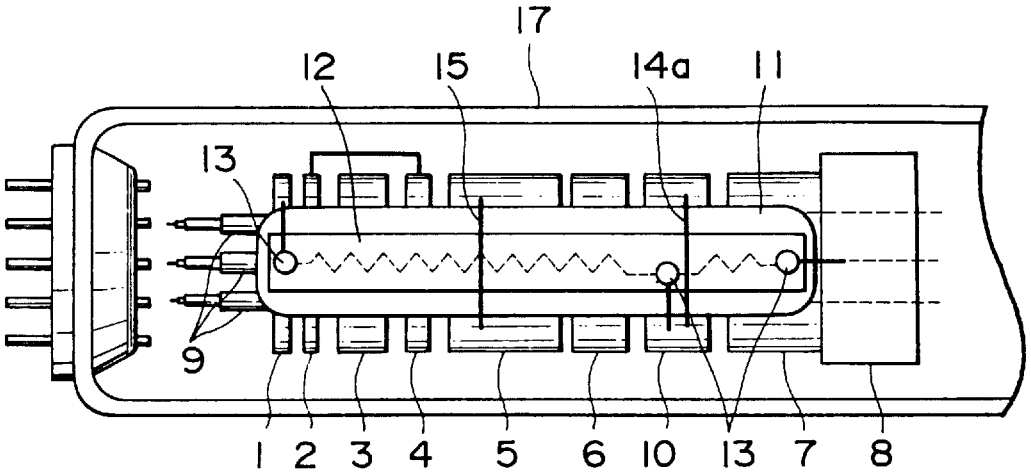
FIG. 5 is a schematic sectional view showing essential portions of a neck portion of a cathode ray tube according to a third embodiment.
Figure 6:
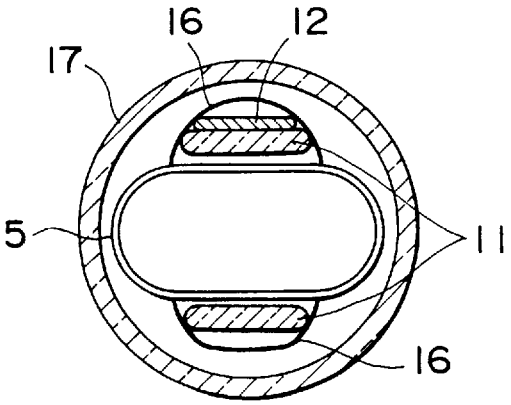
FIG. 6 is an outline sectional view of a conventional neck portion in a focus electrode where a metal line is welded.

Firstly, a metal line 15 surrounding the beading glass 11 on the side where the voltage dividing resistor 12 is installed, is additionally welded to the focus electrode 5 similar to the metal line 14*a* in addition to the first embodiment. FIG. 5 shows a schematic sectional view of the neck portion. In this way, the distance between the inner wall of the neck glass 17 and the focus electrode 5 is further electrically contracted similar to the first embodiment, the amount of electric charge charged on the inner wall of the neck glass 17 opposed to the focus electrode 5 can be stabilized and a synergic effect added with stabilization of potential at the inner wall of the neck glass 17 in the vicinity of the intermediate electrode 10 can be achieved.

Fourth Embodiment

Further, a metal line (not illustrated) surrounding the beading glass 11 on the side where the voltage dividing resistor 12 is not installed, is additionally welded to the focus electrode 5 similar to the second embodiment in addition to the third embodiment.

In this way, the distance between the inner wall of the neck glass 17 and the focus electrode 5 is electrically contracted more than that in the case of the third embodiment and the amount of electric charge charged on the inner wall of the neck glass 17 can further be stabilized.

Fifth Embodiment

Next, the metal line 15 surrounding the beading glass 11 on the side where the voltage dividing resistor 12 is installed, is additionally welded to the focus electrode 5 similar to the metal line 14*a* in addition to the second embodiment. In this way, similar to the third embodiment, the distance between the inner wall of the neck glass 17 and the focus electrode 5 is further electrically contracted and the amount of electric charge charged on the inner wall of the neck glass 17 opposed to the focus electrode 5 can be stabilized and a synergic effect added with stabilization of potential at the inner wall of the neck glass 17 in the vicinity of the intermediate electrode 10 can be achieved.

Sixth Embodiment

A metal line (not illustrated) surrounding the beading glass 11 on the side where the voltage dividing resistor 12 is not installed, is additionally welded to the focus electrode 5 in addition to the fifth embodiment.

In this way, the distance between the inner wall of the neck glass 17 and the focus electrode 5 is electrically contracted more than that in the case of the fifth embodiment and the amount of electric charge charged on the inner wall of the neck glass 17 can further be stabilized.

Seventh Embodiment

Further, in either of the first through the sixth embodiments, after sealing a completed electron gun in the neck portion, the metal lines arranged at the intermediate electrode 10 and the focus electrode 5 are heated by high frequency heating from outside of the neck glass 17 by which a portion of metal included in the metal lines is vaporized and a metal thin film (not illustrated) is formed on the inner wall of the neck glass, the surface of the voltage dividing resistor 12 and on the beading glass 11. According to the first through the sixth embodiments, electric charge charged on the inner wall of the neck glass 17 is charged on the surface of glass that is an insulator. However, according to the embodiment, the above-described metal thin film is present at the vicinities of the inner wall of the neck glass opposed to the metal lines and accordingly, electric charge is stored between the metal thin film and the electrodes opposed thereto and electric potential that is stabilized more than those in the first through the sixth embodiments can be constituted on the inner wall of the neck.

Further, when the metal lines are arranged also on the focus electrode 5 as in the third through the sixth embodiments, by heating by high frequency heating the metal lines on the intermediate electrode and the metal lines on the focus electrode with time difference, in heating one side of the metal lines, the build-in voltage dividing resistor 12 can be constrained to the beading glass 11 by the other side of the metal lines and accordingly, a danger of causing crack in the neck glass by floating up the substrate of the voltage dividing resistor 12 in the heating operation can be prevented and promotion of the withstand voltage characteristic can be achieved by forming a sufficient and uniform vapor-deposited film on the inner wall of the neck glass by both of the metal lines.

As has been explained, according to the present invention, the potential at the inner wall of the neck glass is stabilized by the metal lines arranged at the intermediate electrode and the focus electrode and the metal thin film formed by heating the metal lines, straying leakage current between the holder pin for supplying voltage to the intermediate electrode and a high potential portion such as the anode electrode, a neck carbon film or the like, can be restrained and instability of the intermediate voltage by the leakage current can be prevented and accordingly, the excellent focus characteristics can always be achieved. Further, the forced discharge between the high voltage electrode and the intermediate electrode or the like in the nocking step can stably be caused and a sufficient nocking effect can be achieved and accordingly, the withstand voltage characteristic of the electron gun can be promoted, the destruction of the build-in voltage dividing resistor can be prevented and the reliability can be promoted. Further, the clearance between the inner wall of the neck glass and the metal line needs not to secure more than necessary, the large aperture formation of the lens diameter of the electron gun is facilitated and the focus characteristic can be promoted.

What is claimed is:

1. A cathode ray tube including at the inside of a neck portion of a tube body an electron gun, said electron gun comprising:

a focus electrode;

an anode electrode;

an intermediate electrode applied with a voltage higher than a focus voltage applied on the focus electrode and lower than an anode voltage applied on the anode electrode and disposed between the focus electrode and the anode electrode;

wherein a group of the electrodes are fixed to a plurality of pieces of beading glass along a direction of an axis of the tube body, further comprising;

a build-in resistor forming and supplying the voltage applied on the intermediate electrode which is fixed on one face of one of the plurality of pieces of beading glass;

wherein a face orthogonal to the tube axis of the tube body and including a portion of the intermediate electrode, is provided with a metal line surrounding in a circular arc shape the build-in resistor and the one face of the one of the plurality of pieces of beading glass where the build-in resistor is fixed without being brought into contact with an inner wall of neck glass at the neck portion; and wherein both ends of the metal line are welded to the intermediate electrode.

2. The cathode ray tube according to claim 1, further comprising:

a metal film formed by heating the metal lines from outside of the tube body and vaporizing a portion of the metal lines on surfaces of the inner wall of the neck glass, the build-in resistor and the plurality of pieces of beading glass.

3. The cathode ray tube according to claim 1:

wherein a face orthogonal to the tube axis of the tube body and including a portion of the focus electrode, is provided with a metal line surrounding in a circular arc shape the build-in resistor and the one face of one of the plurality of pieces of beading glass where the build-in resistor is fixed without being brought into contact with the inner wall of the neck glass; and wherein both ends of the metal line are welded to the focus electrode.

4. The cathode ray tube according to claim 1:

wherein a face orthogonal to the tube axis of the tube body and including a portion of the focus electrode, is provided with a metal line surrounding in a circular arc shape the build-in resistor and the one face of the one of the plurality of pieces of beading glass where the build-in resistor is fixed and other metal line surrounding in a circular arc shape other face of other one of the plurality of pieces of beading glass without being brought into contact with the inner wall of the neck glass; and wherein both ends of the metal lines are welded to the focus electrode.

5. A cathode ray tube including at the inside of a neck portion of a tube body an electron gun, said electron gun comprising:

a focus electrode;

an anode electrode;

an intermediate electrode applied with a voltage higher than a focus voltage applied on the focus electrode and lower than an anode voltage applied on the anode electrode and disposed between the focus electrode and the anode electrode;

wherein a group of the electrodes are fixed to a plurality of pieces of beading glass along a direction of an axis of the tube body, further comprising;

a build-in resistor forming and supplying the voltage applied on the intermediate electrode which is fixed on one face of one of the plurality of pieces of beading glass;

wherein a face orthogonal to the tube axis of the tube body and including a portion of the intermediate electrode, is provided with a metal line surrounding in a circular arc shape the build-in resistor and the one face of the one of the plurality of pieces of beading glass where the build-in resistor is fixed and other metal line surrounding in a circular arc shape other face of other one of the plurality of pieces of beading glass without being brought into contact with an inner wall of neck glass at the neck portion; and wherein both ends of the metal lines are welded to the intermediate electrode.

6. The cathode ray tube according to claim 5:

wherein a face orthogonal to the tube axis of the tube body and including a portion of the focus electrode, is provided with a metal line surrounding in a circular arc shape the build-in resistor and the one face of one of the plurality of the pieces of beading glass where the build-in resistor is fixed and other metal line surrounding in a circular arc shape other face of other one of the plurality of pieces of beading glass without being brought into contact with the inner wall of the neck glass; and wherein both ends of the metal lines are welded to the focus electrode.

7. The cathode ray tube according to claim 5:

wherein a face orthogonal to the tube axis of the tube body and including a portion of the focus electrode, is provided with a metal line surrounding in a circular arc shape the build-in resistor and the one face of one of the plurality of pieces of beading glass where the build-in resistor is fixed without being brought into contact with the inner wall of the neck glass; and wherein both ends of the metal line are welded to the focus electrode.

* * * * *